US007660543B2

(12) United States Patent
Watanabe

(10) Patent No.: US 7,660,543 B2
(45) Date of Patent: Feb. 9, 2010

(54) OPERATION PANEL FOR AN ELECTRICAL APPARATUS HAVING INTERCHANGEABLE SHEETS BEARING CHARACTER INFORMATION DEPENDENT ON A SPECIFIC LANGUAGE

(75) Inventor: Toshihiko Watanabe, Osaka (JP)

(73) Assignee: Kyocera Mita Corporation (JP)

( * ) Notice: Subject to any disclaimer, the term of this patent is extended or adjusted under 35 U.S.C. 154(b) by 499 days.

(21) Appl. No.: 11/522,743

(22) Filed: Sep. 18, 2006

(65) Prior Publication Data

US 2007/0071476 A1 Mar. 29, 2007

(30) Foreign Application Priority Data

Sep. 28, 2005 (JP) ..... 2005-281720

(51) Int. Cl.
*G03G 15/00* (2006.01)

(52) U.S. Cl. ..... 399/81; 341/23; 345/156

(58) Field of Classification Search ..... 399/81; 345/156, 173, 184; 341/23
See application file for complete search history.

(56) References Cited

U.S. PATENT DOCUMENTS 4,314,116 A * 2/1982 Gordon ..... 200/5 A
4,806,908 A * 2/1989 Krupnik ..... 341/22
4,942,275 A * 7/1990 Addy et al. ..... 200/308
4,994,988 A * 2/1991 Yokoi ..... 358/1.13

FOREIGN PATENT DOCUMENTS

JP 2004-127060 4/2004

* cited by examiner

*Primary Examiner*—David M Gray
*Assistant Examiner*—Benjamin Schmitt
(74) *Attorney, Agent, or Firm*—Gerald E. Hespos; Anthony J. Casella

(57) ABSTRACT

An electrical apparatus has an apparatus main body and an operation panel with operation buttons for the apparatus main body. The operation panel includes a panel base portion having the operation buttons provided on the outer surface thereof, a first sheet written with the function names of the operable buttons in the form of character information dependent on a specific language, and a second sheet written with the functions of the operation buttons in the form of specified visual information not dependent on the specific language. The first and second sheets are mounted on the outer surface of the panel base portion in such a manner that the second sheet is placed on the first sheet and the first sheet is exchangeable. The second sheet is formed with windows for enabling the character information related to the function names written on the first sheet to be seen.

20 Claims, 8 Drawing Sheets

OPERATION PANEL FOR AN ELECTRICAL APPARATUS HAVING INTERCHANGEABLE SHEETS BEARING CHARACTER INFORMATION DEPENDENT ON A SPECIFIC LANGUAGE

BACKGROUND OF THE INVENTION

1. Field of the Invention

The present invention relates to an electrical apparatus fitted with an operation panel having a plurality of operation buttons such as an image forming apparatus, for example, as exemplified by a copier, and such an operation panel.

2. Description of the Related Art

Generally, in an image forming apparatus as exemplified by a copier, an operation panel operable by a user is provided on the front surface. This operation panel has various operation buttons used to set an operating state of the image forming apparatus and to perform an image forming operation utilizing desired functions. In many cases, character information describing the names of functions to show purposes of utilization, picture sign information describing the functions by means of abstracted figures and the like are respectively attached in the vicinity of such operation buttons or to the front surfaces or the like of such operation buttons.

The picture sign information is for conveying the function to the user in the form of image information and has, as a whole, an advantage that the user can grasp the function at first glance. However, there are also functions difficult to clearly express by picture signs and the user cannot readily understand them in some cases. Accordingly, in terms of user friendliness, it is desirable to express the functions of the operation buttons by attaching not only the picture sign information, but also the character information to the operation panel.

In the case of expressing the functions by the character information, the functions may not be understood by a user unless being written in a language of a linguistic area to which the user belongs. Thus, it is desirable to prepare various kinds of operation panels, each attached with character information corresponding to the linguistic area. For example, there can be employed such a method according to which function name sheets written with the picture signs and the character information described above are prepared for each language, and are mounted in accordance with the linguistic area to which the user belongs. Specifically, for an area like Europe where the same products are commonly sold in different linguistic areas, a method according to which function name sheets prepared in a plurality of languages are included in packages and users set the function name sheets of a necessary language may be employed. Japanese Unexamined Patent Publication No. 2004-127060 discloses a technology of switching a display language on a liquid crystal display in conformity with the language of character information written on labels adhered to an operation unit.

However, according to the method for including the function name sheets prepared in a plurality of languages as described above, the function name sheets prepared in languages other than the one corresponding to the linguistic area to which the user belongs are unnecessary and substantially discarded. In spite of this fact, producers are obliged to include a plurality of function name sheets for each function in the packages and the product cost is increased just by that much. Particularly in the case of color printing picture signs and the like describing functions in order to improve the design effect, an increase in the cost cannot be ignored.

SUMMARY OF THE INVENTION

An object of the present invention is to provide an electrical apparatus fitted with an operation panel as sold for users in various linguistic areas, which apparatus enables the writing language of function names of operation buttons on an operation panel to be easily and inexpensively changed, and also such an operation panel.

In order to accomplish the above object, one aspect of the present invention is directed to an electrical apparatus, comprising an apparatus main body, and an operation panel having various operation buttons for the apparatus main body, wherein the operation panel includes a panel base portion having the operation buttons provided on the outer surface thereof; a first sheet written with the function names of the operable buttons in the form of character information dependent on a specific language; and a second sheet written with the functions of the operation buttons in the form of specified visual information not dependent on the specific language, the first and second sheets being mounted on the outer surface of the panel base portion in such a manner that the second sheet is placed on the first sheet and the first sheet is exchangeable, and the second sheet being formed with windows for enabling the character information related to the function names written on the first sheet to be seen.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, embodiments of the present invention are described with reference to the accompanying drawings.

First Embodiment

Figure 1:
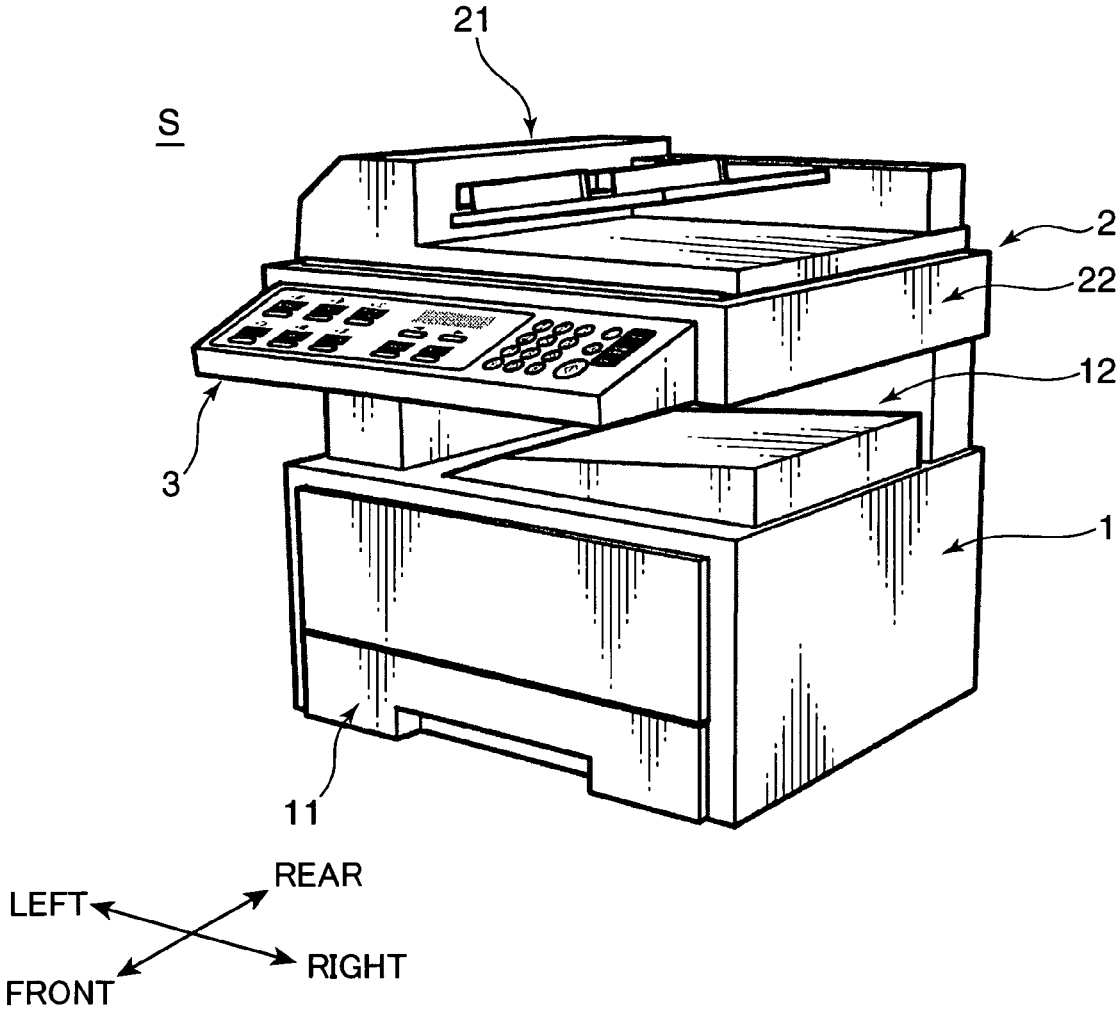
FIG. 1 is a perspective view showing the external configuration of a copier as one example of an electrical apparatus fitted with an operation panel according to the invention.

FIG. 1 is a perspective view showing the external construction of a copier S (image forming apparatus) as one example of an electrical apparatus fitted with an operation panel according to the present invention. The copier S shown in FIG. 1 is roughly comprised of an apparatus main body 1 having a box construction substantially in the form of a hexahedron, an image reader 2 arranged above the apparatus main body 1, and an operation panel 3 mounted before the image reader 2 (on the front surface where a user makes necessary operations).

The apparatus main body 1 is provided with a sheet tray 11 for storing sheets on which images are to be formed and, in addition, internally provided with an image forming assembly, a fixing device and sheet conveyance paths. The image forming assembly is for forming an image on a specified sheet supplied from the sheet tray 11 by transferring a toner image thereto. This image forming assembly includes a photoconductive drum for bearing an electrostatic latent image thereon, a charger unit for charging the outer surface of the photoconductive drum, an exposing unit for forming an electrostatic latent image corresponding to a document image on the outer circumferential surface of the photoconductive drum by means of a laser beam or the like, a developing unit for forming a toner image by attaching developer to the formed electrostatic latent image, a transfer roller for transferring the toner image to the sheet, a charge removing unit for removing residual charges on the outer circumferential surface of the photoconductive drum after the transfer of the toner image, and a cleaning blade for removing residual toner on the outer circumferential surface of the photoconductive drum. The fixing device includes a pair of fixing rollers for separating the sheet having the toner image transferred thereto from the photoconductive drum and fixing the toner image to the sheet.

The image reader 2 is for reading an image of a document to obtain an image data and provided with an automatic document feeder 21 (ADF) and a scanner 22. The automatic document feeder 21 is for automatically feeding a document to be read to the scanner 22. The scanner 22 includes a contact glass on which a document is placed, a mirror unit as an integral unit of an exposure lamp as a light source for illuminating the document with a light and a mirror for reflecting a light reflected by the document, a lens group for condensing the reflected light from the mirror unit, and a CCD image sensor having image pickup devices (CCDs: charge coupled devices) for photoelectrically converting a light image focused by the lens group condensing the reflected light.

An internal sheet discharging portion 12 is disposed between the apparatus main body 1 and the image reader 2. A toner image corresponding to a document image read by the image reader 2 is transferred a sheet fed from the sheet tray 11 in the image forming assembly of the apparatus main body 1, and is fixed to the sheet in the fixing device. Thereafter, the sheet is discharged to the internal sheet discharging portion 12.

The operation panel 3 has operation buttons of various functions related to the image forming operation of the copier S, receives the selection of the function(s) by the user pressing the corresponding operation button(s), and causes the copier S to perform a specified image forming operation in accordance with the selected function(s). In the present inventions, the "operation buttons" widely include rotary knobs, rotary levers, slide levers in addition to push buttons of various shapes, tilting buttons, seesaw-type buttons, touch buttons and the like.

Figure 2:
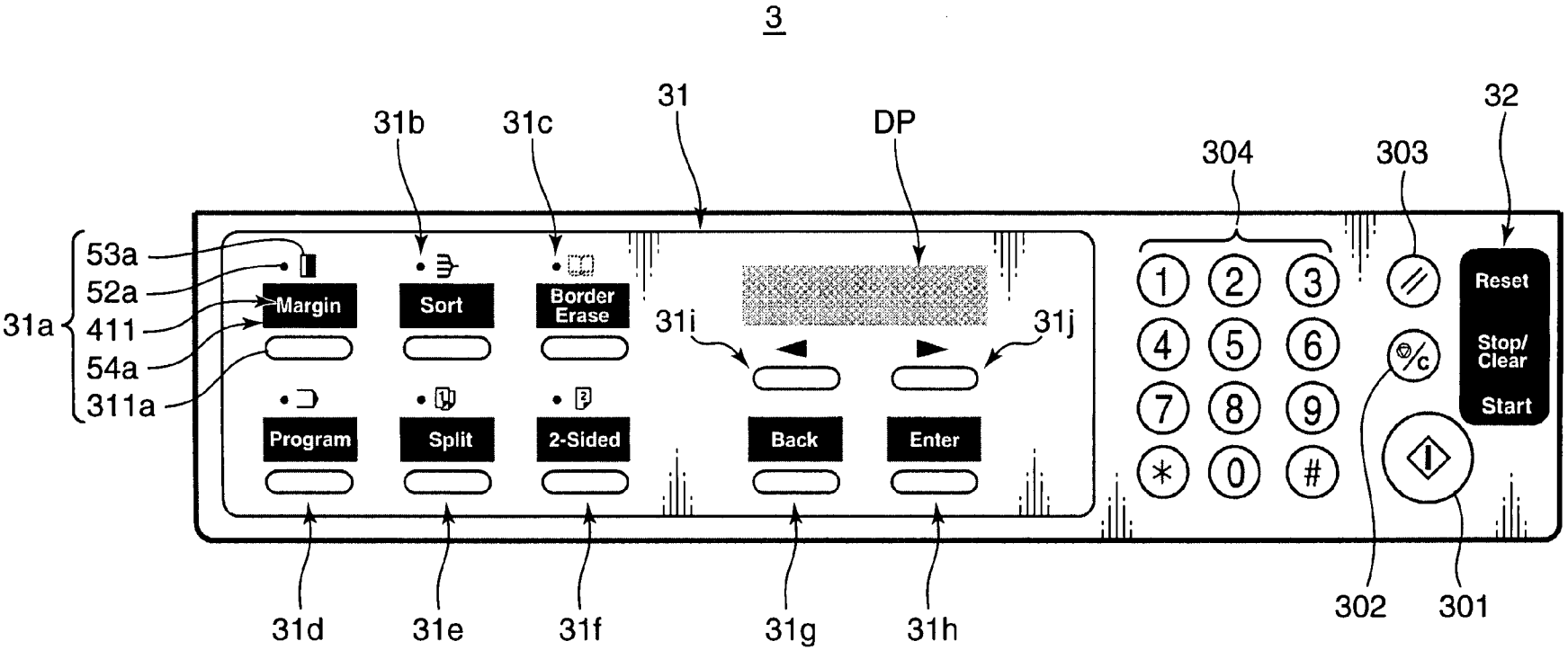
FIG. 2 is a plan view of an operation panel according to a first embodiment.

FIG. 2 is a plan view showing one example of the operation panel 3. This operation panel 3 includes a function operating section 31, a function displaying section 32 having various function buttons (examples of operation buttons), a start button 301 used to start the image forming operation, a stop/clear button 302, a reset button 303, and a numeric pad 304. Specifically, the function operating section 31 includes a margin setting portion 31*a* (Margin), a sort mode setting portion 31*b* (Sort), an erase range setting portion 31*c* (Border Erase), a program job setting portion 31*d* (Program), a split setting portion 31*e* (Split), a duplex copy setting portion 31*f* (2-Sided) 31*f*, a back key 31*g* (Back), an enter key 31*h* (Enter) and cursor keys 31*i*, 31*j*. The function operating section 31 also includes an LCD portion DP for displaying various pieces of function setting information such as a reducing/enlarging magnification.

Among the above various function buttons, the margin setting portion 31*a* is described in detail. This margin setting portion 31*a* is comprised of a margin setting button 311*a* for receiving the selection of a function of forming an image while defining a margin on the sheet, a function name display portion 411 written with the name of this margin function as character information, a pilot lamp display portion 52*a* for displaying the selection of the margin function, a picture sign display portion 53*a* for displaying a picture sign related to the margin function, and a window portion 54*a* enabling the character information of the function name display portion 411 to be seen from the outside. Although the other function buttons are not described in detail, they have similar constructions.

The function displaying section 32 has display portions for displaying the function names (Start, Stop/Clear, Reset) corresponding to the start button 301, the stop/clear button 302 and the reset button 303.

Figure 3:
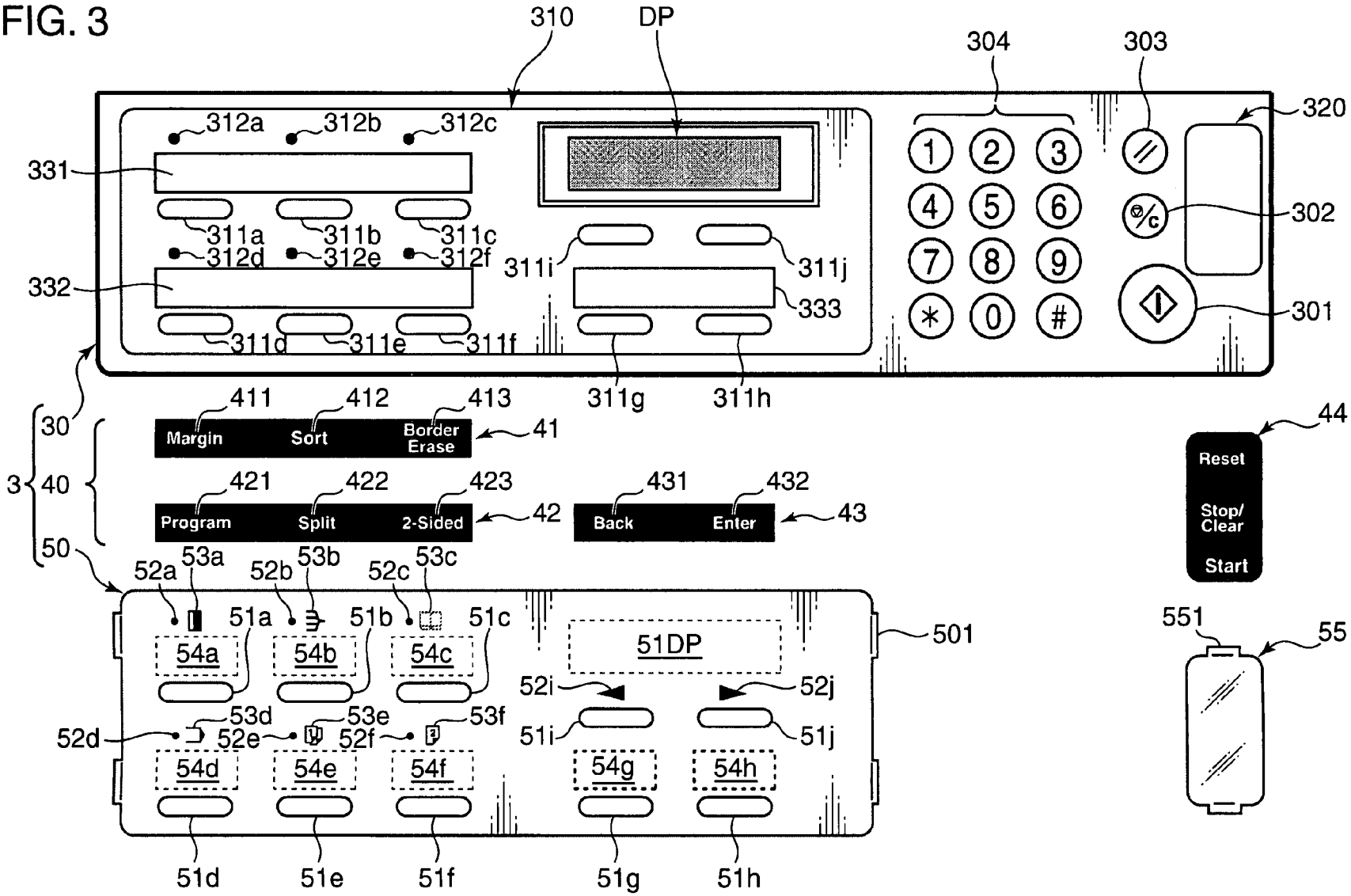
FIG. 3 is an exploded plan view of the operation panel according to the first embodiment.
Figure 4:
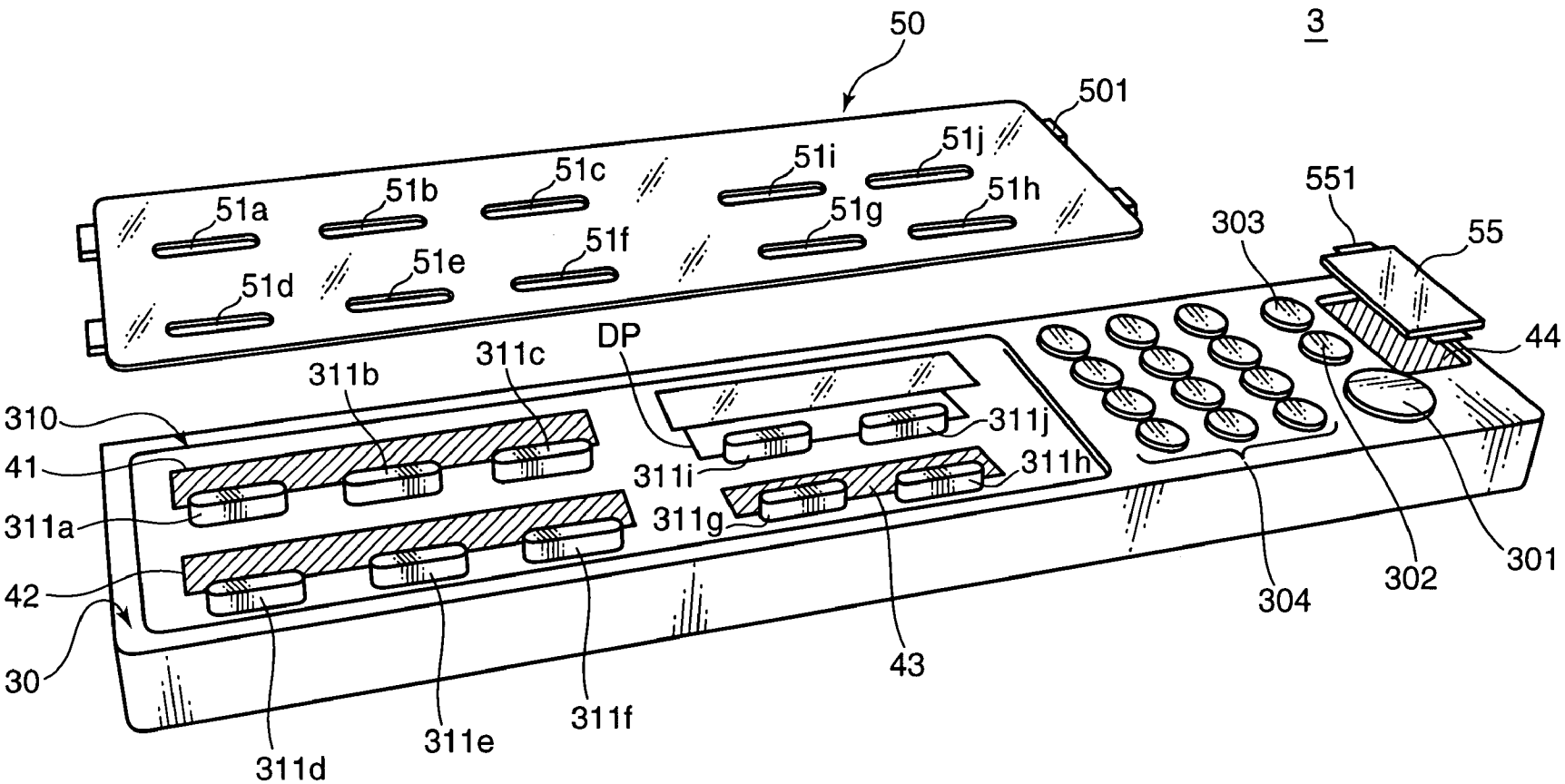
FIG. 4 is an exploded perspective view of the operation panel according to the first embodiment.

FIG. 3 is an exploded plan view of the operation panel 3 and FIG. 4 is an exploded perspective view of the operation panel 3. As shown in FIGS. 3 and 4, the operation panel 3 is provided on an outer surface 30 thereof with a panel base portion 310, first to third sheets 41 to 43 (first sheets 40) written with the function names of the function buttons in the form of character information dependent on a specific language (English in the shown example), a second sheet 50 that is a transparent plate written with picture signs (specified visual information not dependent on a specific language) representing the functions of the function buttons, and a fourth character plate 44 and a cover plate 55 that constitute part of the aforementioned function displaying section 32. As shown in FIG. 4, the first sheets 40 and the second sheet 50 are mounted such that the first sheets 40 are placed on the panel base portion 310 and the second sheet 50 is superimposed thereon.

The panel base portion 310 is provided, as function buttons, with a sort mode button 311*b* corresponding to the sort mode setting portion 31*b* shown in FIG. 2, an erase button 311*c* corresponding to the erase range setting portion 31*c*, a program button 311*d* corresponding to the program job setting portion 31*d*, a split button 311*e* corresponding to the split setting portion 31*e*, a duplex copy button 311*f* corresponding to the duplex copy setting portion 31*f*, a back key button 311*g* corresponding to the back key portion 31*g*, an enter key button 311*h* corresponding to the enter key portion 31*h*, and cursor key buttons 311*i*, 311*j* respectively corresponding to the cursor key portions 31*i*, 31*j* in addition to the aforementioned margin setting button 311*a*, and the aforementioned LCD portion DP.

Further, pilot lamps 312*a* to 312*f* for displaying states of the function selection by the margin setting button 311*a*, the sort mode button 311*b*, the erase button 311*c*, the program button 311*d*, the split button 311*e* and the duplex copy button 311*f* are arranged in correspondence with the arranged positions of the respective function buttons.

Furthermore, a first recess 331 (positioning portion) capable of positioning and accommodating the first character sheet 41 is provided in the vicinity of the margin setting button 311*a*, the sort mode button 311*b* and the erase button 311*c* arranged in a horizontal line. This first recess 331 has a depth substantially equal to the thickness of the fist character sheet 41 and has a size substantially equal to the outer size of the first character sheet 41. Similarly, a second recess 332 capable of positioning and accommodating the second character sheet 42 is provided in the vicinity of the program button 311*d*, the split button 311*e* and the duplex copy button 311*f* arranged in a horizontal line, and a third recess 333 capable of positioning and accommodating the third character sheet 43 is provided in the vicinity of the cursor key buttons 311*i*, 311*j*. It should be noted that a fourth recess 320 capable of positioning and accommodating the fourth character sheet 44 is provided in the vicinity of the start button 301.

The first sheets 40 are strip-shaped paper sheets printed with specified character information in a single color. Specifically, the first character sheet 41 to be accommodated in the first recess 331 includes the function name display portions 411, 412, 413 respectively written with "Margin", "Sort" and "Border Erase" in English in correspondence with the function names of the margin setting button 311*a*, the sort mode button 311*b* and the erase button 311*c* adjacent when being accommodated.

Similarly, the second character sheet 42 to be accommodated in the second recess 332 includes function name display portions 421, 422, 423 respectively written with "Program", "Split" and "2-Sided" in English in correspondence with the function names of the program button 311*d*, the split button 311*e* and the duplex copy button 311*f* adjacent when being accommodated. Further, the third character sheet 43 to be accommodated in the third recess 333 includes function name display portions 431, 432 respectively written with "Back" and "Enter" in English in correspondence with the function names of the cursor key buttons 311*i*, 311*j* adjacent when being accommodated. The fourth character sheet 44 is also written with character information of "Start", "Stop/Clear" and "Reset" in English in correspondence with the start button 301, the stop/clear button 302 and the reset button 303.

The second sheet 50 is a transparent multicolor plate (of course, may be a single-color plate) formed by color printing visual information including picture signs related to the functions on a transparent sheet base material. The second sheet 50 includes button holes 51*a* to 51*j* into which the aforementioned function buttons are fitted, pilot lamp display portions 52*a* to 52*f*, 52*i* and 52*j*, picture sign display portions 53*a* to 53*f* for displaying the picture signs related to the respective functions, and windows 54*a* to 54*h* for enabling the character information written on the first sheets 40 to be seen.

The button holes 51*a* to 51*j* are formed so as not to impair the operability of the margin setting button 311*a* and the other function buttons when the second sheet 50 is mounted on the panel base portion 310, and the respective function buttons are fitted into the corresponding button holes 51*a* to 51*j*. The pilot lamp display portions 52*a* to 52*f*, 52*i* and 52*j* are arranged in correspondence with the pilot lamps 312*a* to 312*f* provided on the panel base portion 310 so as to let pilot lights given forth from the pilot lamps 312*a* to 312*f* pass through. The picture sign display portions 53*a* to 53*f* are portions showing specified picture signs clearly describing the functions selectable by the respective function buttons without depending on a specific language, and are arranged adjacent to the corresponding pilot lamps 312*a* to 312*f*. The picture sign display portions 53*a* to 53*f* are formed by color printing or the like.

The windows 54*a* to 54*h* are transparent portions (where no color printing is applied) for enabling the function name display portions 411 to 413, 421 to 423, 431 to 432 to be seen with the first to third character sheets 41 to 43 accommodated in the first to third recesses 331 to 333. It should be noted that the windows 54*a* to 54*h* may not be transparent portions, but may be formed by making cutouts in the transparent sheet base material similar to the button holes 51*a* to 51*j*. Further, an LCD window 51DP is so provided as to correspond to the arranged position of the LCD portion DP of the panel base portion 310.

The second sheet 50 is provided with claw portions 501 at the opposite sides thereof. These claw portions 501 are detachably engageable with unillustrated locking portions provided on the panel base portion 310, and the second sheet 50 is mounted on the panel base portion 310 using the claw portions 501. Upon mounting, the first to third character sheets 41 to 43 are first accommodated into the first to third recesses 331 to 333 and the second sheet 50 is so mounted as to cover the first to third character sheet 41 to 43 from above. Further, in the case of exchanging the first to third character sheets 41 to 43 by those written with character information for another linguistic area, the character sheets can be exchanged by disengaging the claw portions 501 to detach the second sheet 50 from the panel base portion 310.

The cover plate 55 is a transparent plate to which no color printing or the like is applied, and adapted to cover the fourth character sheet 44. This cover plate 55 is also provided with claw portions 551 and can be mounted on the fourth recess 320 using these claw portions 551. In the case of exchanging the fourth character sheet 44 for another character sheet written with character information for another linguistic area, the fourth character sheet 44 can be similarly exchanged by disengaging the claw portions 551 to detach the cover plate 55.

The copier S according to this embodiment described above is constructed such that the first sheets 40 and the second sheet 50 mounted on the outer surface 30 of the operation panel 3 in such a state where the second sheet 50 is placed on the first sheet 40 and the first sheets 40 are exchangeable. The picture sign display portions 53*a* to 53*f* unaffected by linguistic areas, i.e. common in all countries are color printed on the second sheet 50, whereas the character information dependent on a specific language (English in the shown example) is written on the first sheets 40 in a single color. Accordingly, if a plurality of kinds of first sheets 40 written with the function names in the form of character information for a plurality of linguistic areas are prepared, users in a plurality of linguistic areas can be easily dealt with only by exchanging the first sheets 40. Further, since it is not necessary to exchange the second sheet 50 unaffected by the linguistic areas, a cost increase can be suppressed just by that much. In other words, the cost can be more reduced as compared to a case where a plurality of transparent color plates written with both picture signs and function names are prepared (included in packages) for the respective different linguistic areas or a case where a plurality of first sheets 40 color-printed with both function names and picture signs are included in packages (in this case, the second sheet 50 is merely a transparent plate).

Further, since the first sheets 40 are paper sheets printed with the character information and it is sufficient to exchange such paper sheets in accordance with the language area, a user can easily build a system for obtaining the first sheets 40, for example, by downloading data corresponding to the first sheets 40 from a specified Internet website and printing out the downloaded data or by printing out contents of a CD-ROM as an instruction manual included in the package of the copier S. In such a case, resources are not wasted since the user can obtain only the first sheets 40 written with the function names in a language suitable for him, and the cost can be further reduced since the producer needs not supply a plurality of first sheets 40 written with character information for linguistic areas having sale potentiality.

Further, the first sheets 40 made of paper sheets can be protected since the second sheet 50 is placed on the first sheet 40. For example, even if the user downloads data corresponding to the first sheets 40, prints them out and cuts the printout into strips, the first sheets 40 are exposed only through the windows 54*a* to 54*h* of the second sheet 50. Thus, the appearance is not spoiled even if the printout is cut in a disorderly manner. Further, since the second sheet 50 is made of a transparent color plate to which color printing is applied, it is also possible to improve the design effect.

Second Embodiment

Although the first sheets 40 are in the form of three strip-shaped paper sheets (first to third character sheets 41 to 43) in the first embodiment, a single sheet may constitute the first sheet. Such an embodiment is described below. In the following description, the functions of the function buttons themselves are not described in order to facilitate the description.

Figure 5:
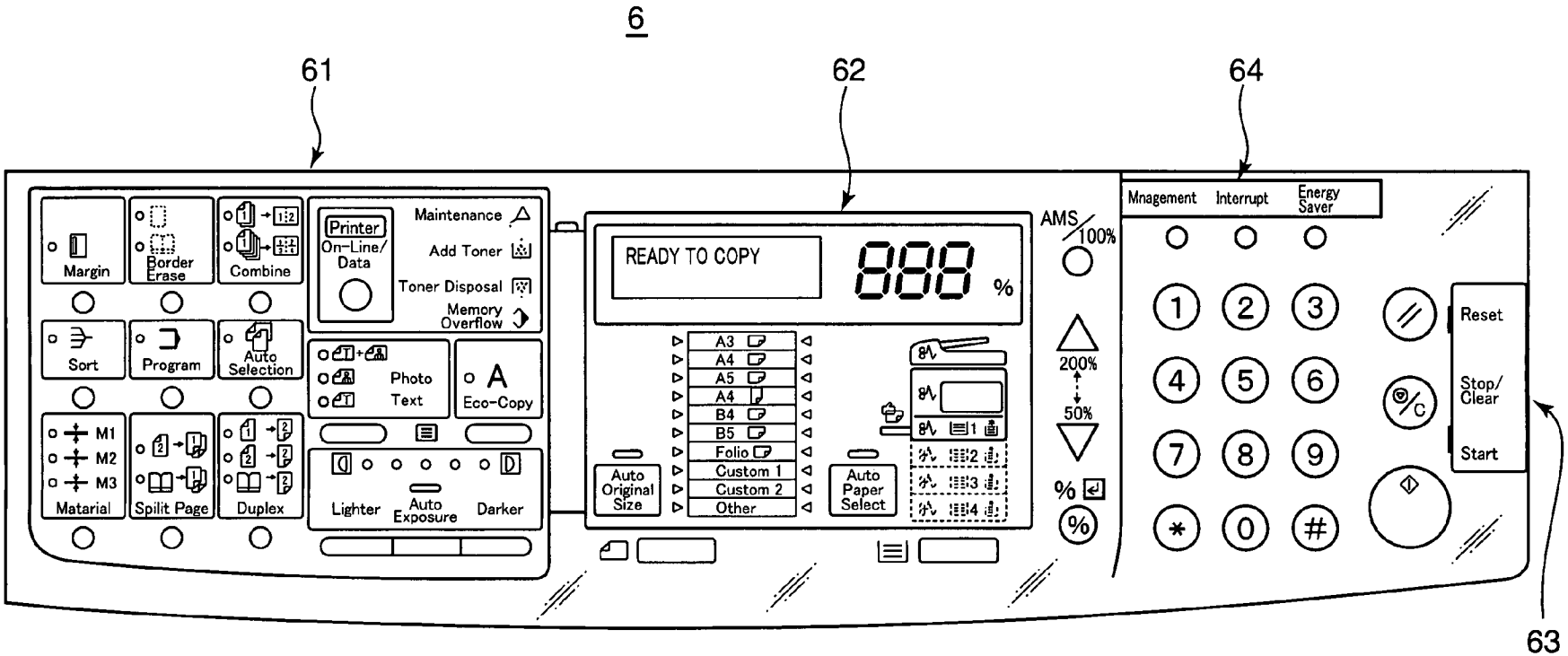
FIG. 5 is a plan view of an operation panel according to a second embodiment of the invention.

FIG. 5 is a plan view showing an operation panel 6 according to a second embodiment of the invention. This operation panel 6 is provided with a first function operating section 61, a second function operating section 62, a first function displaying section 63 and a second function displaying section 64 in addition to a numeric pad and the like.

Figure 6:
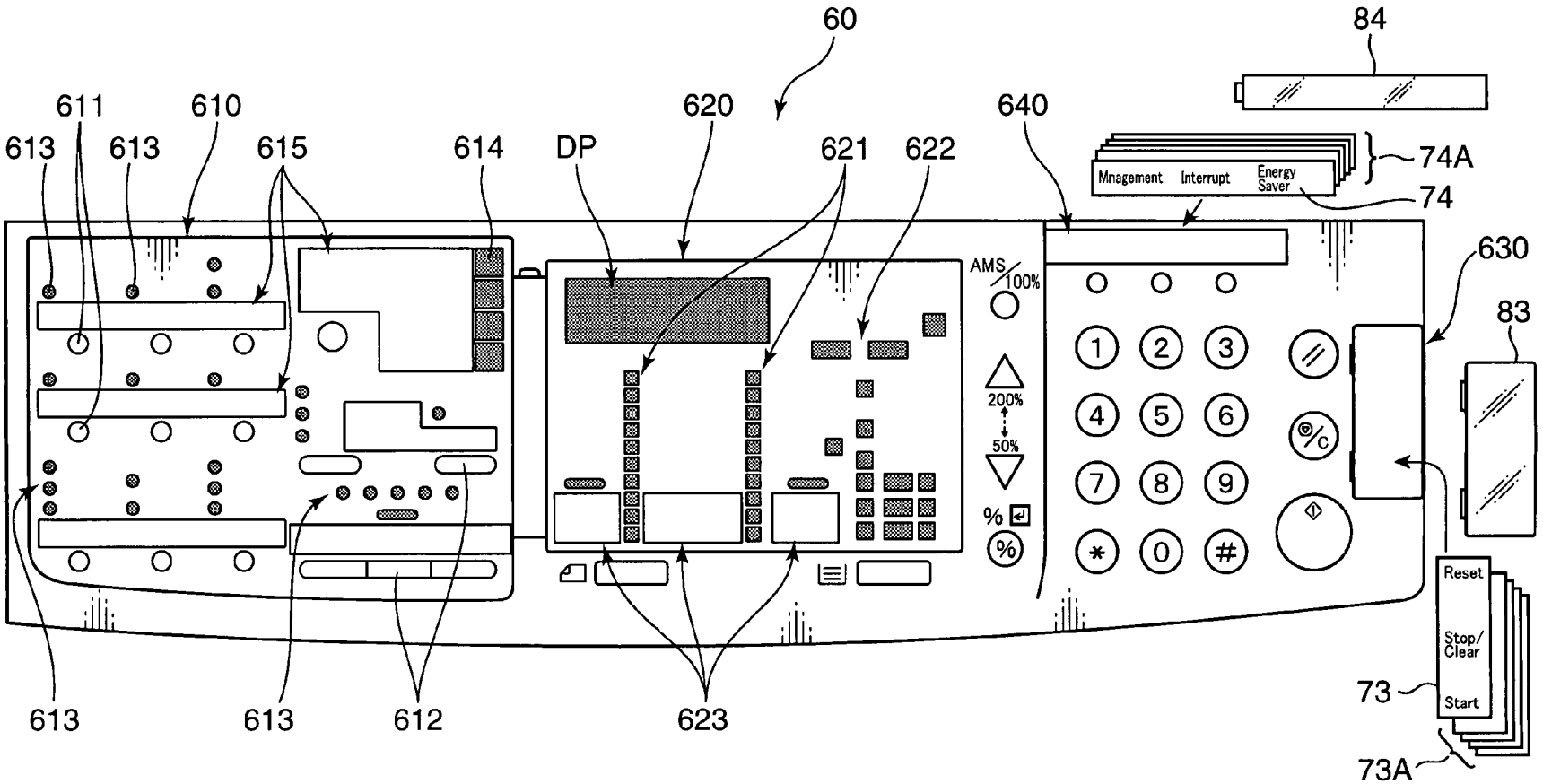
FIG. 6 is a plan view showing a panel base portion of the operation panel according to the second embodiment.
Figure 7A:
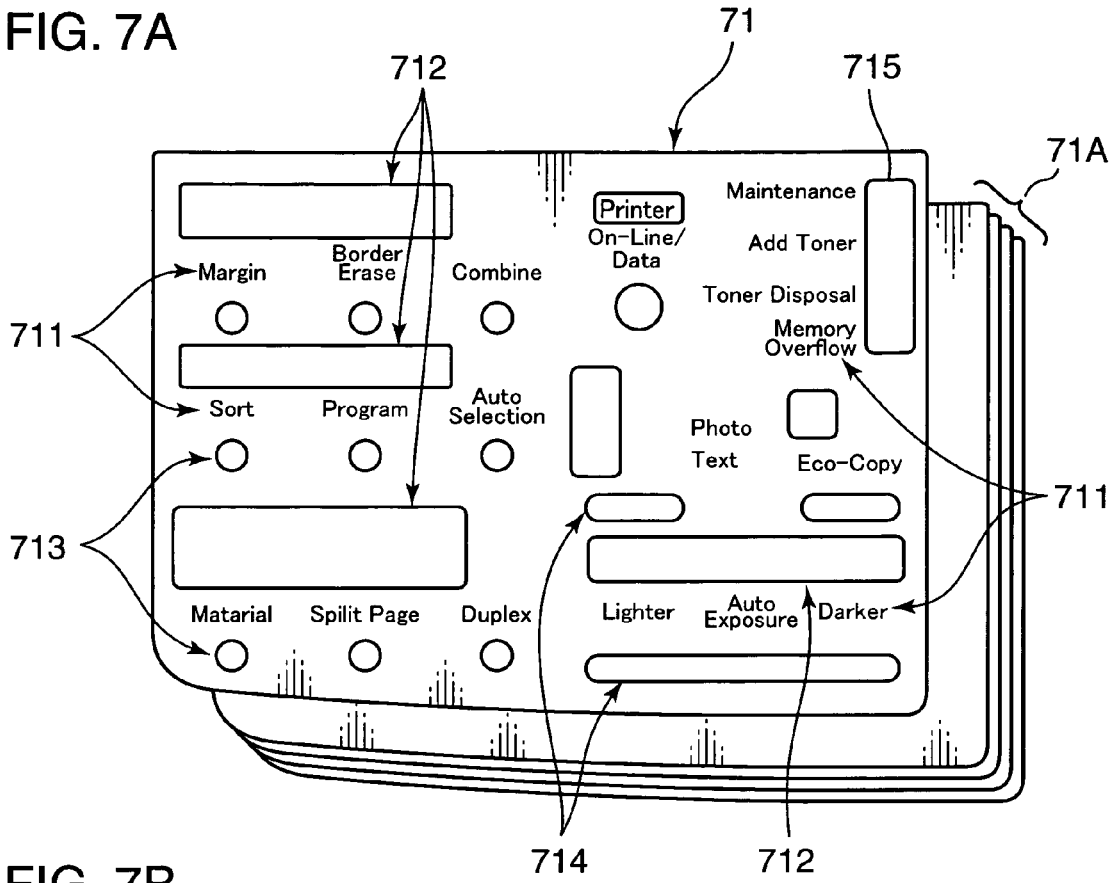
FIG. 7A is a plan view showing a first function name sheet (first sheet) used for the operation panel according to the second embodiment.
Figure 7B:
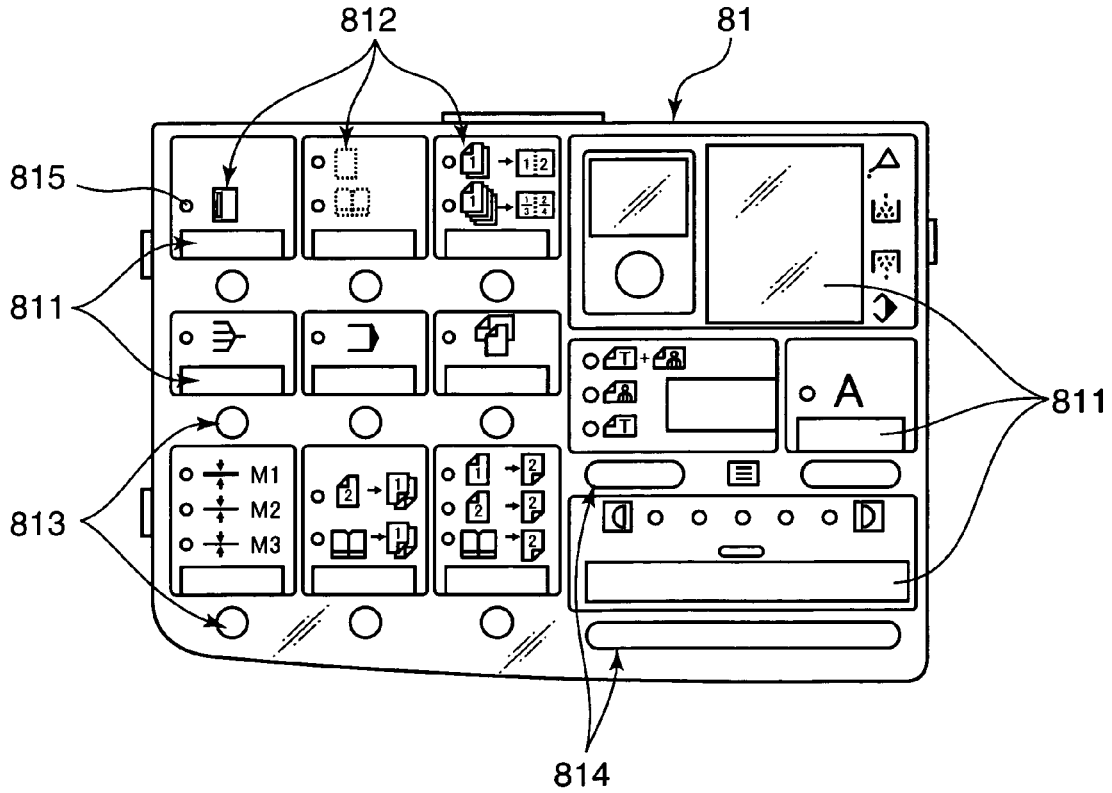
FIG. 7B is a plan view showing a first decorative plate (second sheet) used for the operation panel according to the second embodiment.
Figure 8A:
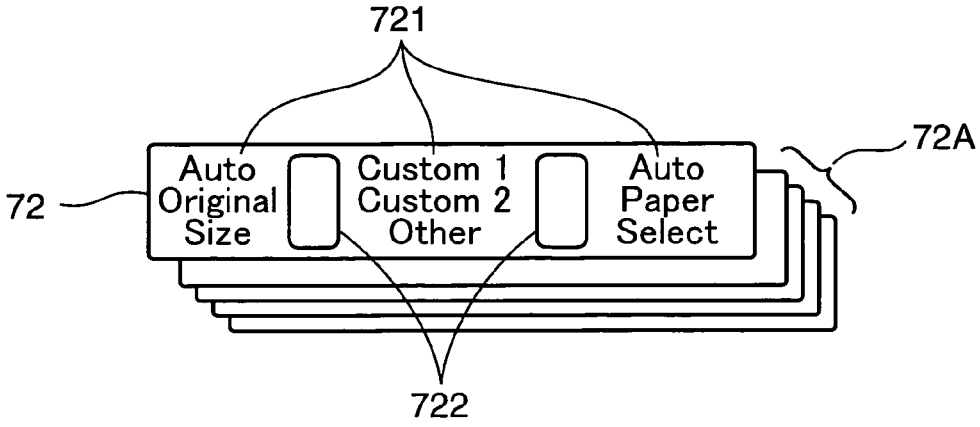
FIG. 8A is a plan view showing a second function name sheet (first sheet) used for the operation panel according to the second embodiment.
Figure 8B:
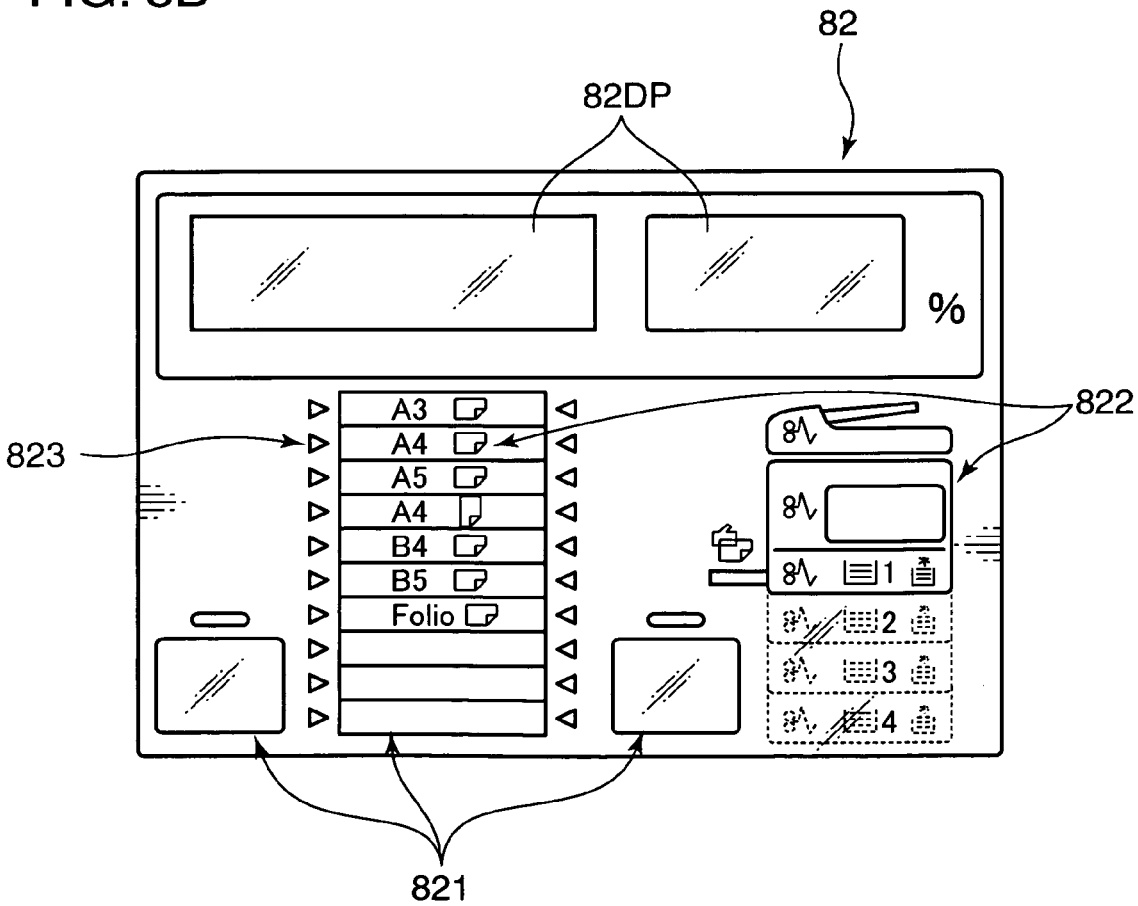
FIG. 8B is a plan view showing a second decorative plate (second sheet) used for the operation panel according to the second embodiment.

FIG. 6 is a plan view showing a panel base portion 60 of the operation panel 6. This panel base portion 60 is provided with a first panel base portion 610 and a second panel base portion 620 respectively in conformity with the first and second function operating sections 61, 62 and also with a first panel recess 630 and a second panel recess 640 respectively in conformity with the first and second function operating portions 63, 64. A first function name sheet 71 (first sheet) shown in FIG. 7A and a first decorative plate 81 (second sheet) shown in FIG. 7B are successively placed one over the other on the first panel base portion 610. Further, a second function name sheet 72 (first sheet) shown in FIG. 8A and a second decorative plate 82 (second sheet) shown in FIG. 8B are successively placed one over the other on the second panel base portion 620.

Further, a third function name sheet 73 and a first cover plate 83 are mounted in the first panel recess 630 and a fourth function name sheet 74 and a second cover plate 84 are mounted in the second panel recess 640 as shown in FIG. 6.

In FIG. 6, specified numbers of round function buttons 611, the flat function buttons 612, pilot lamps 613, back lights 614 and recesses 615 are provided at specified positions on the first panel base portion 610. The function buttons 611, 612 are for receiving the function selection; the pilot lamps 613 are for displaying the state of the function selection; the back lights 614 are similarly for displaying the state of the function section; and the recesses 615 are provided in correspondence with the display positions of the function names. The second panel base portion 620 is similarly provided with pilot lamps 621, back lights 622 and recesses 623 and additionally provided with an LCD portion DP.

The first function name sheet 71 to be mounted on the first panel base portion 610 is a single paper sheet printed with the function names of all the function buttons 611, 612 provided on the first panel base portion 610 in a specific language (English in the shown example) in a single color (e.g. in black). As shown in FIG. 7A, this first function name sheet 71 includes function name display portions 711 corresponding to the respective function buttons 611, 612, oblong holes 712 for pilot lamps to permit the transmission of lights emitted from the pilot lamps 613, round through holes 713 through which the round function buttons 611 are inserted, flat through holes 714 through which the flat function buttons 612 are inserted, and oblong holes 715 for back lights to permit the transmission of lights emitted from the back lights 614. A plurality of first function name sheets 71A having function name display portions 711 written in languages of other linguistic areas (French, Italian, etc.) and having the same shape are prepared for exchange in addition to the first function name sheet 71 having the function name display portions 711 written in English.

The first decorative plate 81 is a transparent color plate color-printed with specified visual information not dependent on the specific language. As shown in FIG. 7B, the first decorative plate 81 is provided with windows 811 for enabling the function name display portions 711 of the first function name sheet 71 to be seen, picture sign display portions 812 for displaying picture signs related to the functions of the function buttons 611, 612, round button holes 813 through which the round function buttons 611 are inserted, flat button holes 814 through the flat function buttons 612 are inserted, and pilot lamp display portions 815.

Such first function name sheet 71 and first decorative plate 81 are placed one over the other on the first panel base portion 610. Specifically, the first function name sheet 71 is placed on the first panel base portion 610 by fitting the round through holes 713 and the flat through holes 714 of the first function name sheet 71 to the round function buttons 611 and the flat function buttons 612 of the first panel base portion 610. Thereafter, the first decorative plate 81 is placed on the first function name sheet 71 by similarly fitting the round button holes 811 and the flat button holes 814 of the first decorative plate 81 to the round function buttons 611 and the flat function buttons 612 of the first panel base portion 610, and is engaged and fixed by a specified engaging mechanism. In the case of exchanging the first function name sheet 71 for the one having the function name display portions 711 written in another language, the first decorative plate 81 is detached and a suitable one is selected from the first function name sheets 71A to exchange the first function name sheet 71 for it.

The second function name sheet 72 to be mounted on the second panel base portion 620 is a strip-shaped paper sheet having function names related to operation functions provided on the second panel base portion 620 in a specific language (English in the shown example) in a single color. As shown in FIG. 8A, this second function name sheet 72 is provided with function name display portions 721 and oblong holes 722 for pilot lamps to permit the transmission of lights emitted from the pilot lamps 621. In this way, a plurality of second function name sheets 72A for exchange having the function name display portions 721 written in characters of other linguistic areas and having the same shape are prepared in addition to the second function name sheet 72 having the function name display portions 721 written in English.

The second decorative plate 82 is a transparent color plate color-printed with specified visual information not dependent on the specific language. As shown in FIG. 8B, the second decorative plate 82 is provided with windows 821 for enabling the function name display portions 721 of the second function name sheet 72 to be seen, picture sign display portions 822 for displaying picture signs related to the functions, pilot lamp display portions 823 and LCD windows 82DP.

Such second function name sheet 72 and second decorative plate 82 are mounted by first placing the second function name sheet 72 on the second panel base portion 620 and then placing the second decorative plate 82 on the second function name sheet 72. In the case of exchanging the second function name sheet 72 for the one having the function name display portions 721 written in another language, the second decorative plate 82 is detached and a suitable one is selected from the second function name sheets 72A to exchange the second function name sheet 72 for it.

Similarly, third function name sheets 73A for exchange and fourth function name sheets 74A for exchange are prepared for the third and fourth function name sheets 73 and 74. In the case of exchanging them for those written in another language, the first color plate 83 and the second color plate 84 are detached, suitable ones are selected from the third function name sheets 73A for exchange and fourth function name sheets 74A to exchange the third and fourth function name sheets 73, 74 for them.

According to the operation panel 6 described as above, the display mode of the function names can be let to match the linguistic area of the user only by exchanging the first to fourth function name sheets 71 to 74 having the function names printed in a specific language in a single color. Further, each of the first to fourth function name sheets 71 to 74 is made of a single sheet. For example, in the case of the first function name sheet 71, it can be mounted only by fitting the round through holes 713 and the flat through holes 714 to the round function buttons 611 and the flat function buttons 612 of the first panel base portion 610, wherefore there is an advantage of good operability in exchanging the function name sheets.

The present invention is not limited to the embodiments described above and can be, for example, embodied as follows.

Although the copier S is described as one example of the electrical apparatus fitted with the operation panel in the above embodiments, the present invention is also applicable to various other image forming apparatuses such as facsimile machines, printers and composite apparatuses and also widely applicable to other electrical apparatuses having operation panels.

Although the transparent plate is used as the second sheet 50 in the above embodiments, the transparent plate may not be used if windows are formed to enable the function names written on the first sheets 40 to be seen in the case of an operation panel having neither pilot lamps nor back lights.

Although paper sheets are used as the first sheets 40 in the above embodiments, plastic sheets or the like may be used instead.

The aforementioned specific embodiments mainly embrace features of the inventions having the following constructions.

An electrical apparatus according to one aspect of the present invention comprises an apparatus main body, and an operation panel having various operation buttons for the apparatus main body, wherein the operation panel includes a panel base portion having the operation buttons provided on the outer surface thereof; a first sheet written with the function names of the operable buttons in the form of character information dependent on a specific language; and a second sheet written with the functions of the operation buttons in the form of specified visual information not dependent on the specific language, the first and second sheets being mounted on the outer surface of the panel base portion in such a manner that the second sheet is placed on the first sheet and the first sheet is exchangeable, and the second sheet being formed with windows for enabling the character information related to the function names written on the first sheet to be seen.

An operation panel according to another aspect of the present invention comprises a panel base portion having operation buttons provided on the outer surface thereof; a first sheet written with the function names of the operable buttons in the form of character information dependent on a specific language; and a second sheet written with the functions of the operation buttons in the form of specified visual information not dependent on the specific language, wherein the first and second sheets are mounted on the outer surface of the panel base portion in such a manner that the second sheet is placed on the first sheet and the first sheet is exchangeable, and the second sheet is formed with windows for enabling the character information related to the function names written on the first sheet to be seen.

With these constructions, sheets with notations related to the functions of the operation buttons are divided into the first sheet having the character information dependent on the specific language and the second sheet written with the specified visual information not dependent on the specific language, and are mounted on the outer surface of the operation panel in such a manner that the first sheet is exchangeable. Accordingly, users in a plurality of linguistic areas can be easily dealt with only by exchanging the first sheet, and it is not necessary to exchange the common part (second sheet) unaffected by the linguistic areas. Thus, the cost increased can be suppressed just by that much. Therefore, electrical apparatuses (operation panels) as sold to users in various linguistic areas can be inexpensively produced.

In the above constructions, it is desirable that:

[i] The second sheet is a transparent plate formed by printing the visual information including picture signs related to the functions in a specified part of a transparent sheet base material excluding the windows and the first sheet is a paper sheet printed with the character information, or

[ii] The second sheet is a transparent color plate formed by color-printing the visual information including picture signs related to the functions in a specified part of a transparent sheet base material excluding the windows and the first sheet is a paper sheet printed with the character information in a single color.

With these constructions [i], [ii], the second sheet is printed (color-printed) with the visual information including the picture signs unaffected by the linguistic areas, whereas the first sheet is written with the character information dependent on the specific language. The first sheet can be inexpensively made since being a paper sheet, and the first sheet made of a paper sheet can be protected by the second sheet made of a transparent plate. Further, since the first sheet is a paper sheet printed with the character information (single-color printing), a user can easily build a system for obtaining the first sheet, for example, by downloading data corresponding to the first sheet from a specified Internet website and printing out the downloaded data or by printing out contents of a CD-ROM as an instruction manual included in the package of the electrical apparatus.

Further, with the construction [i], the first sheet is a paper sheet written with the character information and it is sufficient to exchange such a first sheet in conformity with the linguistic area, wherefore the electrical apparatus can be more inexpensively produced. Further, a system for printing out the first sheet at the user side can be built, utilizing the Internet or the like. In this case, it can be dispensed with to include a plurality of first sheets in the package of the electrical apparatus so as to deal with a plurality of linguistic areas, wherefore the cost can be further reduced.

Further, with the construction [ii], the first sheet is a paper sheet printed with the character information in the single color and it is sufficient to exchange such a first sheet in conformity with the linguistic area, wherefore the electrical apparatus can be more inexpensively produced. Further, since the second sheet is a color-printed transparent color plate, the design effect can also be improved. Similar to the above, a system for printing out the first sheet at the user side can be built, utilizing the Internet or the like. In this case, even a user having only a monocolor printer can receive this service.

In the above constructions, the first sheet may be comprised of a plurality strip-shaped paper sheets and the second sheet may be one transparent plate. Alternatively, the first sheet may be one paper sheet and the second sheet may be one transparent plate. Further, the panel base portion may be divided at least into a first panel base portion and a second panel base portion, wherein the first sheet comprised of one paper sheet and the second sheet comprised of one transparent plate are mounted on each of the first and second panel base portions. With these constructions, the first sheet and the second sheet can be mounted on the panel base portion in such modes adapted to various demands.

In any of the above constructions, a positioning portion used to position and mount the first sheet is provided at a specified position on the outer surface of the operation panel. With this construction, the first sheet can be easily positioned using the positioning portion upon being mounted on the outer surface of the operation panel. Therefore, the operability of the user who actually mounts the first sheet can be improved.

In this case, the positioning portion is preferably a recess provided in the vicinity of the operation buttons, in which recess the first sheet can be accommodated while being positioned. With this construction, the first sheet can be positioned at the specified position on the outer surface of the operation panel only by fitting the first sheet into the recess, wherefore the operability can be further improved.

In any of the above constructions, the first and second sheets may be formed with through holes through which the operation buttons are passed. With this construction, the first and second sheets are mounted on the operation panel with the operation buttons passed through the through holes. In this case, the through holes formed in the first sheet also function as positioning portions used to mount the first sheet. Accordingly, the first and second sheets can be mounted on the operation panel without impairing the operability of the operation buttons only by engaging the operation buttons with the through holes of the first and second sheets.

An image forming apparatus according to still another aspect of the present invention comprises an apparatus main body for performing an image forming operation, and an operation panel provided with operation buttons having various functions related to the image forming operation in the apparatus main body, wherein the operation panel includes a panel base portion having the operation buttons provided on the outer surface thereof; a first sheet written with the function names of the operable buttons in the form of character information dependent on a specific language; and a second sheet written with the functions of the operation buttons in the form of specified visual information not dependent on the specific language, the first and second sheets being mounted on the outer surface of the panel base portion in such a manner that the second sheet is placed on the first sheet and the first sheet is exchangeable, and the second sheet being formed with windows for enabling the character information related to the function names written on the first sheet to be seen.

With this construction, the operability of the image forming apparatus for a user can be improved only by exchanging the first sheet in conformity with the linguistic area of the user.

This application is based on patent application No. 2005-281720 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An electrical apparatus, comprising:

an apparatus main body, and an operation panel having various operation buttons for the apparatus main body, wherein the operation panel includes:

a panel base portion having the operation buttons provided on the outer surface thereof;

a first sheet written with the function names of the operable buttons in the form of character information dependent on a specific language; and a second sheet written with the functions of the operation buttons in the form of specified visual information not dependent on the specific language, the first and second sheets being mounted on the outer surface of the panel base portion in such a manner that the second sheet is placed on the first sheet and the first sheet is exchangeable, and the second sheet including windows for enabling the character information related to the function names written on the first sheet to be seen and a colored surface on which the specified visual information not dependent on the specific language is provided.

2. An electrical apparatus according to claim 1, wherein the first sheet is a paper sheet printed with the character information.

3. An electrical apparatus according to claim 2, wherein the character information is printed on the first sheet in a single color.

4. An electrical apparatus according to claim 1, wherein the first sheet includes a plurality of strip-shaped paper sheets.

5. An electrical apparatus according to claim 1, wherein the first sheet is one paper sheet and the second sheet is one colored plate.

6. An electrical apparatus according to claim 1, wherein the panel base portion is divided at least into a first panel base portion and a second panel base portion, and the first sheet comprised of one paper sheet and the second sheet comprised of one transparent plate are mounted on each of the first and second panel base portions.

7. An electrical apparatus according to claim 1, further comprising a positioning portion provided at a specified position on the outer surface of the panel base portion and used to position and mount the first sheet.

8. An electrical apparatus according to claim 7, wherein the positioning portion is a recess provided in the vicinity of the operation buttons, in which recess the first sheet can be accommodated while being positioned.

9. An electrical apparatus according to claim 1, wherein the first and second sheets are formed with through holes through which the operation buttons are passed.

10. An image forming apparatus, comprising:

an apparatus main body for performing an image forming operation, and an operation panel provided with operation buttons having various functions related to the image forming operation in the apparatus main body, wherein the operation panel includes:

a panel base portion having the operation buttons provided on the outer surface thereof;

a first sheet written with the function names of the operable buttons in the form of character information dependent on a specific language; and a second sheet written with the functions of the operation buttons in the form of specified visual information not dependent on the specific language, the first and second sheets being mounted on the outer surface of the panel base portion in such a manner that the second sheet is placed on the first sheet and the first sheet is exchangeable, and the second sheet including windows for enabling the character information related to the function names written on the first sheet to be seen and a colored surface on which the specified visual information not dependent on the specific language is provided.

11. An operation panel, comprising:

a panel base portion having operation buttons provided on the outer surface thereof;

a first sheet written with the function names of the operable buttons in the form of character information dependent on a specific language; and a second sheet written with the functions of the operation buttons in the form of specified visual information not dependent on the specific language, wherein the first and second sheets are mounted on the outer surface of the panel base portion in such a manner that the second sheet is placed on the first sheet and the first sheet is exchangeable, and the second sheet including windows for enabling the character information related to the function names written on the first sheet to be seen and a colored surface on which the specified visual information not dependent on the specific language is provided.

12. An operation panel according to claim 11, wherein the first sheet is a paper sheet printed with the character information.

13. An operation panel according to claim 12, wherein the first sheet is a paper sheet printing with the character information in a single color.

14. An operation panel according to claim 11, wherein the first sheet includes a plurality of strip-shaped paper sheets.

15. An operation panel according to claim 11, wherein the first sheet is one paper sheet.

16. An operation panel according to claim 11, wherein the panel base portion is divided at least into a first panel base portion and a second panel base portion, and the first sheet comprised of one paper sheet and the second sheet comprised of one colored plate are mounted on each of the first and second panel base portions.

17. An operation panel according to claim 11, further comprising a positioning portion provided at a specified position on the outer surface of the panel base portion and used to position and mount the first sheet.

18. An operation panel according to claim 17, wherein the positioning portion is a recess provided in the vicinity of the operation buttons, in which recess the first sheet can be accommodated while being positioned.

19. An operation panel according to claim 11, wherein the first and second sheets are formed with through holes through which the operation buttons are passed.

20. An operation panel according to claim 11, wherein the colored surface of the second sheet surrounds the windows, the specified visual information not dependent on the specific language being printed on the colored surface at locations in proximity to the windows and in proximity to the operation buttons of the panel base portion.

* * * * *